United States Patent [19]

Hawthorne

[11] 4,001,058

[45] Jan. 4, 1977

[54] PROCESS FOR THE PREPARATION OF DEKENYL ACRYLATES AND METHACRYLATES AND PRODUCTS THEREOF

[75] Inventor: Marion F. Hawthorne, Huntsville, Ala.

[73] Assignee: Rohm and Haas Company, Philadelphia, Pa.

[22] Filed: Mar. 10, 1961

[21] Appl. No.: 94,937

Related U.S. Application Data

[63] Continuation-in-part of Ser. No. 783,614, Dec. 29, 1958, abandoned.

[52] U.S. Cl. ..... 149/22; 149/44; 260/486 R; 260/606.5 B; 526/328

[51] Int. Cl.[2] ..... C06L 25/00; C08F 218/00

[58] Field of Search ..... 260/486, 606.5, 466, 260/89.5, 86.1, 86.1 R, 86.1 E, 89.5 R, 486 R; 149/22

[56] References Cited

UNITED STATES PATENTS

| | | | |
|---|---|---|---|
| 2,987,388 | 6/1961 | Stanley | 149/7 X |
| 2,988,435 | 6/1961 | Stanley et al. | 149/19.91 |

*Primary Examiner*—Leland A. Sebastian

EXEMPLARY CLAIM

3. An ester of the formula in which $n$ is 1 to 2 and R is a radical selected from the group consisting of $(H\phi CH_2)_2CH-$, $(H\phi)_2CH-$, $H\phi CH_2-$, $H\phi(CH_2)_2-$, $H\phi(CH_2)_3-$, $H\phi(CH_2)_4-$, $H\phi(CH_2)_5-$, and $(CH_3\phi)_2CH-$ in which formula–$\phi$–represents $-C_2B_{10}H_{10}-$.

18 Claims, 1 Drawing Figure

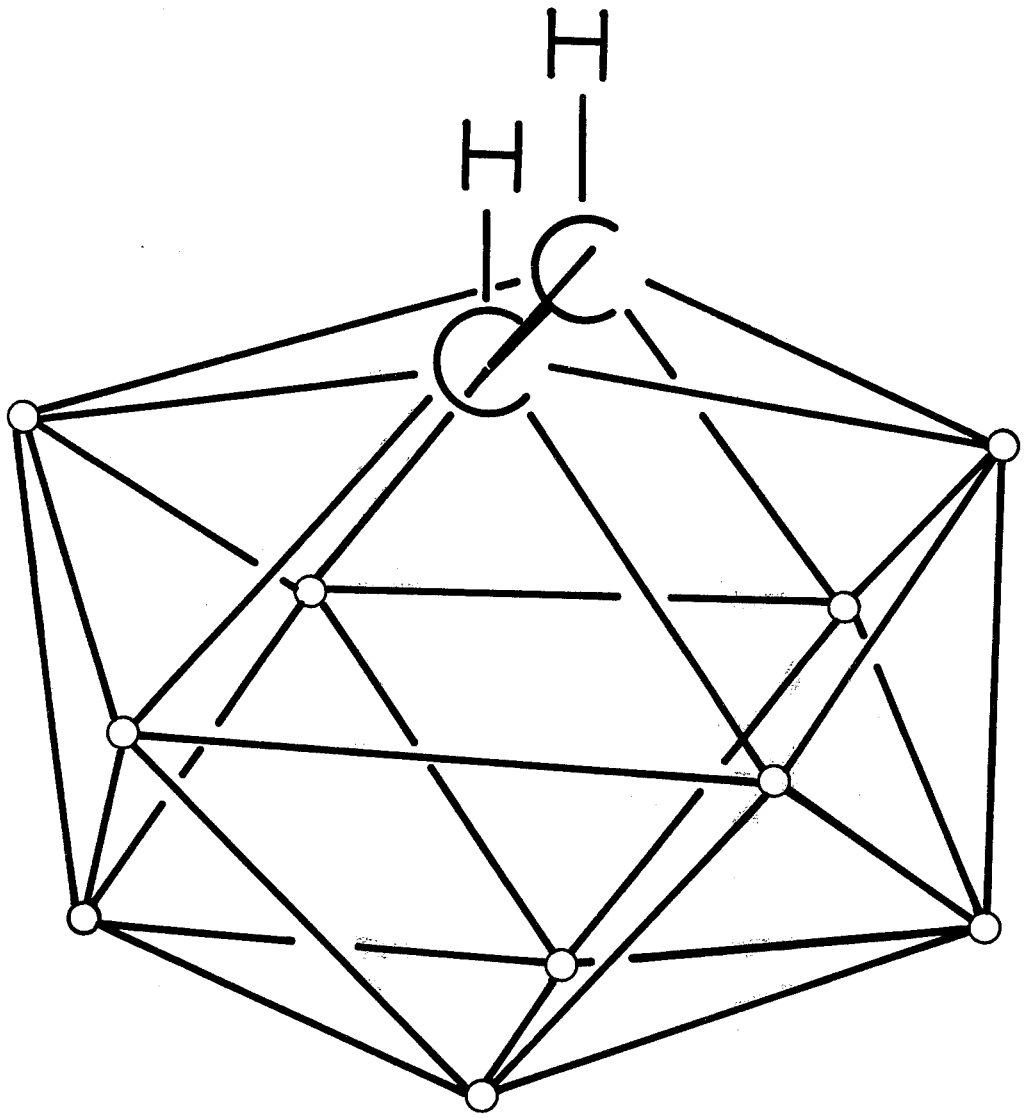
INVENTOR
MARION F. HAWTHORNE
BY Frederick Lyons
ATTORNEY

PROCESS FOR THE PREPARATION OF DEKENYL ACRYLATES AND METHACRYLATES AND PRODUCTS THEREOF

This application is a continuation-in-part of Ser. No. 783,614, filed Dec. 29, 1958, now abandoned.

This invention concerns a process for the preparation of dekenyl acrylates and methacrylates and the products produced thereby.

Boron compounds are of particular interest as components of propellant charges, such as are used in missiles, rockets, etc., becuse they are high energy compounds and, when used with oxidizers and other additives, provide very high specific impulse, a much sought after characteristic. However, the simpler boron compounds tend to be unstable, and more stable boron compounds have long been sought.

While it would be possible to incorporate stable boron compounds into propellant compositions without chemically reacting the boron compounds with the other components of the propellant charge, there are serious limitations on the amount of a boron-containing compound which can be incorporated if it does not react to form a polymeric compound with good physical properties. There are definite lower limits to the physical properties which a propellant grain must possess, and, because of the necessity for using high proportions of an oxidizer such as ammonium perchlorate, many of the propellant grains presently used are not substantially above these minimum requirements. Thus, the addition of any appreciable amount of boron-containing compounds which did not contribute to the physical strength of the grain is frequently impossible. Boron-containing compounds which would yield polymers having good physical properties by polymerization or by condensation reactions would, therefore, be most desirable.

One preferred method of making propellant "grains" or charges consists in casting a mixture of various additives plus a compound, which can be termed a "monomer", which will subsequently form an elastic tough rubbery polymer by condensation or polymerization reactions and function as a binder for the entire propellant charge. This method permits uniform dispersion of all components throughout the propellant mass and, more important, permits casting the mixture into casings or molds at relatively low safe temperatures. Obviously, with potentially explosive or highly combustible mixtures, such as must be used for high energy propellants, the ability to cast these compositions satisfactorily at relatively low temperatures is a tremendously important safety factor. After casting, the monomeric compound is reacted to form a polymer, which polymer, as hereinbefore set forth, functions as a binder for the entire propellant charge.

An object of the present invention is to make available stable boron-containing monomers having very high boron content which can be polymerized to polymers, which polymers exhibit very desirable physical properties for use in propellants.

Another object of the present invention is to make available boron-containing monomers with high boron content which can be cast at relatively low safe temperatures, which monomers can be subsequently polymerized at relatively low temperatures to form tough elastic polymers with good tensile strength, which polymers can function as high energy binders for the entire propellant charge.

Because of the newness of the entire field of boron chemistry, the nomenclature for boron compounds is still in a state of flux. However, workers in this field of boron chemistry have agreed that the compound formed by the reaction of one mole of acetylene with one mole of decaborane is "dekene", of the empirical formula $H—C_2B_{10}H_{10}—H$. This nomenclature will be used throughout the specification and the claims and, when explained as set forth below, will be completely understandable to those skilled in the art.

The postulated structural formula for dekene is shown on page 6, the white circles being boron atoms to each of which a hydrogen atom is attached. Dekene is represented by the empirical formula $$H—C_2B_{10}H_{10}—H.$$

The dekenyl radical is, therefore, $$H—C_2B_{10}H_{10}—$$

and the dekinyl radical is $$—C_2B_{10}H_{10}—.$$

For simplicity, the dekenyl radical is represented by the symbol —Ð— and this symbolism is used throughout the specification and the claims. While it is important to know the structure of dekene from a scientific standpoint, it is not as important from the standpoint of the present invention. Throughout the reactions shown in the present invention, the dekinyl radical, $$—C_2B_{10}H_{10}—,$$

remains unchanged. Only the terminal hydrogen atoms are reactive under the reaction conditions herein employed.

Dekene is prepared by the reaction of acetylene with decaborane, $B_{10}H_{14}$, by loss of four hydrogen atoms from the decaborane molecule. It is preferred to carry out the reaction using acetonitrile as a solvent, and the reaction is effected at reflux temperature which, in the case of acetonitrile, is 80° C. to 85° C. This reaction is well-known to those skilled in the art.

In FIG. I, the open circles represent boron atoms, and to each of these a hydrogen atom is attached. However, inserting the hydrogen atoms in the proper spatial relationship makes a structural formula which is difficult to comprehend.

On the basis of those skilled in the art, this represents the best postulation of the structural formula of this compound, but it should be understood that this is a postulation, based on the best knowledge which is available at the present time.

The process of the present invention comprises reacting hydroxy dekenyl compounds with the acyl halides of acrylic and methacrylic acids, the halogen of said halide having an atomic weight from 35 to 80. The corresponding dekenyl acrylates and dekenyl methacrylates are formed. The acid chlorides of acrylic and methacrylic acids are generally used for reasons of economy and availability, but the acid bromides are equally effective.

Suitable hydroxy dekenyl compounds which can be employed in the process of this invention include the following:

| | |
|---|---|
| Bis(dekenylmethyl) carbinol | $(HDCH_2)_2$—CHOH |
| Didekenyl carbinol | $(HD)_2$—CHOH |
| Dekenyl methanol | HD—$CH_2OH$ |
| 2-Dekenyl ethanol | HD—$(CH_2)_2$—OH |
| 3-Dekenyl propanol-1 | HD—$(CH_2)_3$—OH |
| 4-Dekenyl butanol-1 | HD—$(CH_2)_4$—OH |
| 5-Dekenyl pentanol-1 | HD—$(CH_2)_5$—OH |
| Bis(methyldekenyl) carbinol | $(CH_3D)_2$—CHOH |

These hydroxy dekenyl compounds can be prepared by a number of methods. Thus, bis(dekenylmethyl) carbinol can be prepared by reacting dekenylmethyl bromide with magnesium to form the Grignard complex ($HDCH_2$ MgBr) and reacting two moles of the Grignard complex with ethyl formate to form the carbinol. Didekenyl carbinol can be prepared by reacting acetylene with decaborane to form dekene, treating the dekene with phenyllithium to form the lithium dekene, and treating two moles of lithium dekene with one mole of ethyl formate to form didekenyl carbinol. Didekenyl carbinol can also be prepared by treating the acetate of diethinyl carbinol with decarborane and hydrolyzing the acetate of didekenyl carbinol so formed. Dekenyl carbinol can be prepared by reacting 3-acetoxypropyne-1 with decaborane to form dekenylmethyl acetate, followed by hydrolysis to form dekenyl carbinol. In the general formula $HD(CH_2)_nOH$, $n$=2 can be formed by treating 4-acetoxybutyne-1 and $n$=3 can be formed by treating 5-acetoxypentyne-1 using the same process set forth hereinbefore for 3-acetoxypropyne-1. These acetoxy acetylene derivatives are commercially available. The higher homologues can be prepared by the same process. The compounds $n$=2 and $n$=3 in the formula $HD(CH_2)_nOH$ can be prepared by an alternate process as follows: propargyl bromide ($CH \equiv C—CH_2Br$) is reacted with decaborane to form dekenylmethyl bromide. This bromide is reacted with magnesium to form the Grignard complex which is subsequently reacted with formaldehyde to form 2-dekenyl ethanol or with ethylene oxide to form 3-dekenyl propanol-1. Dimethyloldekene can be prepared by reacting 1,4-diacetoxybutyne-2 with decaborane to form bis(acetoxymethyl)dekene, and subsequently hydrolyzing the bisacetoxy derivative to dimethyloldekene.

The dekenyl acrylates and methacrylates of the present invention are prepared by reacting the hydroxy dekenyl compounds set forth hereinbefore with acryloyl or methacryloyl halides. One common method comprises reacting the hydroxy dekenyl compounds with the acryloyl or methacryloyl halide in solution in an inert solvent, i.e. in a solvent which is non-reactive with the hydroxy dekenyl compound, the acyl halide or the resulting ester, such as acetonitrile, dioxane, methylene chloride, chloroform, acetone, methyl ethyl ketone, or ethylene dichloride, in the presence of an organic base. While triethylamine represents the most economical amine, other lower trialkylamines, other than trimethylamine, can be used. These include tripropylamine, tributylamine, butyldimethylamine, triamylamine, amyldiethylamine and amyldimethylamine. The ratio of amine to acid halide must be at least 1 to 1, and a slight excess of amine is preferred. Thus, the ratio can be 1.5 to 1 or even as high as 4 to 1, but large excesses, such as at a ratio of 4 to 1, do not show any appreciable advantages and do not represent preferred embodiments. Sufficient solvent is used to give readily stirrable reaction mixtures, and although larger quantities of solvents can be used, there is little, if any, advantage to be gained.

Another process for the preparation of dekenyl acrylates and methacrylates comprises treating the hydroxy dekenyl compounds with a hydrocarbon lithium compound and treating the complex so formed with acryloyl or methacryloyl halide. The molar ratio of hydroxy compound to the hydrocarbon lithium compound used is 1 mole of the hydrocarbon lithium compound per mole of hydroxyl group in the hydroxy compound.

A wide variety of hydrocarbon lithium compounds can be used in the hereinbefore-described process for the preparation of dekenyl acrylates and methacrylates. Thus, alkyllithium compounds, such as propyllithium and butyllithium, are satisfactory. Aryllithium compounds represent the preferred type, but, in general, any hydrocarbon lithium compound can be used. Typical aryllithium compounds include diphenylmethane lithium, trityl-(i.e., triphenylmethane)lithium, fluorenyllithium and naphthalenelithium. Phenyllithium represents a particularly preferred lithium compound.

For some reason, as yet unexplained, the hydrocarbon lithium compound method of preparation yields purer compounds, lighter colored, more easily worked up.

While large excesses of the acid halide can be used without altering the nature of the reactions, any excess must be removed and constitutes any unnecessary disadvantage. Molar ratios of hydroxyl to acid halide may be as high as 1 to 2, but a preferred embodiment employs only a 10% to 15% excess of acid halide.

The acrylate or methacrylate monomers of the present invention may be used as homopolymers or they may advantageously be used as comonomers with other ethylenically unsaturated polymerizable monomers. Vinyl trinitratopentaerythritol ether is of particular interest as a comonomer for use in propellant charges, since the copolymer exhibits improved physical properties when used as a binder for propellant charges. Many of these acrylate or methacrylate monomers are relatively high melting solids. Thus, the acrylate prepared by reacting bis(dekenylmethyl) carbinol with acryloyl chloride melts at approximately 150° C. Since it is preferred to cast propellant charges at about 70° C., it is necessary to lower the melting point by copolymerizing with a lower melting (or a liquid) monomer or by the use of plasticizers.

Other suitable comonomers include methyl acrylate, ethyl acrylate, butyl acrylate, 2-ethylhexyl acrylate and the higher alkyl esters of methacrylic and ethacrylic acids. Esters of this type include the butyl 2-ethylhexyl, decyl and lauryl esters of methacrylic and ethacrylic acids. The amount of these plasticizing esters used will depend on the other components of the propellant grain and the specific plasticizing monomer used. Generally, however, from 5% to 20% of plasticizing monomer, based on the weight of the dekenyl acrylate or methacrylate, will provide the desired degree of plasticization.

Other suitable monoethylenically unsaturated monomers including monovinylidene monomers include the following: propyl acrylate, isopropyl acrylate, tert-butyl acrylate, cyclohexyl acrylate, isobornyl acrylate, benzyl acrylate, phenyl acrylate, alkylphenol acrylate, ethoxymethyl acrylate, ethoxyethyl acrylate, ethoxypropyl acrylate, propoxymethyl acrylate, propoxyethyl acrylate, propoxypropyl acrylate, ethoxyphenyl acrylate, ethoxybenzyl acrylate, ethoxycyclohexyl acrylate, and the corresponding esters of methacrylic acid, styrene, vinyltoluene, vinylnaphthalene, and similar unsaturated monomers.

Copolymers of the above monomers with monovinylene compounds, such as dialkyl maleates, dialkyl fumarates, dialkyl crotonates, dialkyl itaconates, and dialkyl glutaconates are also possible.

The molecular weights of the polymers of the present invention may be varied over wide ranges and still be within the scope of the invention. The term "molecular weights" as used herein refers to the weight average or viscosity average molecular weights. The polymers may be liquids of low molecular weight, viscous gums of higher molecular weights, to hard and tough solids of very high molecular weight depending on the intended use. Useful polymers can be prepared in which the polymer molecule contains as low as about 5 monomer units, which, depending on the specific monomer employed, is a molecular weight or viscosity molecular weight of about 2000. Polymers which contain as high as 5000 monomer units per polymer molecule are also useful. The preferred range is from 10 to 3000 monomer units per polymer molecule or "chain".

The physical properties of the polymers resulting from polymerizing the monomers of the present invention can be altered by copolymerizing said monomers with polyethylenically unsaturated compounds. Thus, it is possible to obtain cross-linked structures with varying degrees of cross-linking depending on the amount and composition of the polyethylenically unsaturated compounds used. The varying degrees of cross-linking are, in turn, accompanied by varying degrees of thermoplasticity, rigidity and solubility in solvents. The ability to vary the physical properties of the polymers of this invention is not only of importance when they are employed as binders for propellant grains, but also when they are employed in other applications.

Suitable polyethylenically unsaturated compounds include the following: divinylbenzene, divinylpyridine, divinyltoluenes, divinylnaphthalenes, diallyl phthalate, ethylene glycol diacrylate, ethylene glycol dimethacrylate, divinylxylene, divinylethylbenzene, divinyl sulfone, polyvinyl or polyallyl ethers of glycol, of glycerol, of pentaerythritol, of mono-, or dithio-derivatives of glycols, and of resorcinol, divinylketone, divinylsulfide, allyl acrylate, diallyl maleate, diallyl fumarate, diallyl succinate, diallyl carbonate, diallyl malonate, diallyl oxalate, diallyl adipate, diallyl sebacate, divinylsebacate, diallyl tartrate, diallyl silicate, triallyl tricarballylate, triallyl aconitate, triallyl citrate, triallyl phosphate, N,N'-methylenediacrylamide, N,N'-methylenedimethacrylamide, N,N'-ethylenediacrylamide, 1,2-di($\alpha$-methylmethylene sulfonamido)ethylene, trivinylbenzene, trivinylnaphthalene, polyvinylanthracenes, butadiene and isoprene.

The acrylate and methacrylate monomers of the present invention can be polymerized, either alone or in a mixture with other copolymerizable ethylenically unsaturated compounds using a number of methods well-known to those skilled in the art. Thus, compounds which provide free radicals will initiate polymerization.

Suitable catalysts which provide free radicals which function as reaction initiators include benzoyl peroxide, tert-butyl hydroperoxide, cumene peroxide, tetralin peroxide, acetyl peroxide, caproyl peroxide, tert-butyl perbenzoate, tert-butyl diperphthalate, methyl ethyl ketone peroxide, etc.

The amount of peroxidic catalyst required is roughly proportional to the concentration of the mixture of monomers. The usual range is 0.01% to 3% of catalyst with reference to the weight of the monomer mixture. The preferred range if from 0.2% to 1.5%. The optimum amount of catalyst is determined in large part by the nature of the particular monomers selected, including the nature of the impurities which may accompany said monomers.

Another suitable class of free radical generating compounds are the azo catalysts. There may be used, for example, azodiisobutyronitrile, azodiisobutyramide, azobis($\alpha$,$\alpha$-dimethylvaleronitrile), azobis($\alpha$-methylbutyronitrile), dimethyl, diethyl, or dibutyl azobis(-methylvalerate). These and other similar azo compounds serve as free radical initiators. They contain an —N—N— group attached to aliphatic carbon atoms, at least one of which is tertiary. An amount of 0.01% to 2% on the weight of monomer or monomers is usually sufficient.

While suitable physical properties can be obtained by copolymerizing dekenyl acrylates or methacrylates with other ethylenically unsaturated compounds, the specific impulse developed by the propellant grain may be decreased appreciably, particularly if the amount of the other ethylenically unsaturated compounds used be an appreciable portion of the grain. Another method of plasticizing polymers of dekenyl acrylates or methacrylates, which represents the preferred embodiment, uses nitrato esters of alcohols as plasticizers. The alcohols may be monohydric, dihydric or trihydric and it is not necessary to have all of the hydroxyl groups nitrated. The preferred embodiment employs alcohols which do not contain more than ten carbon atoms. Typical plasticizers include dekenylmethyl nitrate, dekenylpropyl nitrate, diethylene glycol dinitrate, triethylene glycol dinitrate, glycerol dinitrate, butanetriol trinitrate, etc. These nitrato esters are of themselves high energy compounds and so their use causes little reduction in the specific impulse of the grain. The amounts of these plasticizers used will vary with the particular dekenyl monomers employed and the physical properties required in the propellant grain, but will be in the range of about 5% to about 30% on the weight of the dekenyl monomer.

As set forth hereinbefore, the monomers of the present invention, when polymerized, are valuable as high energy binders for propellant grains. They are used in conjunction with an oxidizer which oxidizer may vary widely in chemical composition. Thus, ammonium, lithium, sodium, or potassium perchlorates and nitrates or mixtures of these salts are commonly employed as oxidizers in propellant grains. Although presenting greater handling problems, liquid oxygen and liquid fluorine are also very efficient oxidizers.

Powdered aluminum may be added as an additional fuel and to control the burning characteristics of the propellants.

The compositions set forth in Table I (all parts are parts by weight) were prepared by mixing all the components at a temperature of 30° C. until a uniform mixture was obtained and cast into "motors" which were 2.0 inches in diameter and 4 inches long. The propellant was cured in the motor at 60° C. for 48 hours, and then subjected to standard ballistic tests. The results of these tests are recorded in Table I:

TABLE I

| PROPELLANT COMPOSITIONS | MVD-6 | MVD-7 | MVD-8 | MVD-9 |
|---|---|---|---|---|
| Ammonium Perchlorate | 74.2 | 69.27 | 72.0 | 67.36 |
| Dekenylmethyl acrylate | 15.5 | 18.44 | 16.8 | 13.58 |
| Dekenylpropylnitrate | 10.3 | 12.29 | 11.2 | 9.05 |
| Aluminum | 10.3 | 12.29 | 11.2 | 10.00 |

| BALLISTIC DATA | MVD-6 | MVD-7 | MVD-8 | MVD-9 |
|---|---|---|---|---|
| K | | | | |
| $r_b$ | 2.402 | 1.068 | 1.863 | 1.525 |
| $P_{max}$ | 1316. | 469. | 829. | 692. |
| $P_b$ | 607. | 300. | 460. | 399. |
| c* | 5165. | 5080. | 5139. | 4961. |
| $F^o_{1000}$ | 246.5 | 242.3 | 236.2 | 237.3 |
| $C^o_F$ | 1.535 | 1.534 | 1.478 | 1.538 |

Although ammonium perchlorate was used as the oxidizer in these tests to permit comparison of the results with those on other propellants, it should be understood that other oxidizers, including those set forth hereinbefore, can be satisfactorily employed.

In a similar manner, a propellant of the following composition was prepared. This composition is balanced with respect to $HBO_2$:

| | | |
|---|---|---|
| Ammonium perchlorate | 74.25 | parts by weight |
| Dekenylethyl nitrate | 10.30 | parts by weight |
| Dekenylmethyl acrylate | 15.45 | parts by weight |
| Ferric Oxide | 0.5 | parts by weight. |

Ballistic tests gave the following data:

| | |
|---|---|
| $r_b$ | 2.91 in./sec. at 577 |
| $F^o_{1000}$ | 240.6 sec. |
| $P_a$ | 537 psi. |

PREPARATION OF INTERMEDIATES

Preparation of Dekenylmethyl Acetate

Into a 3-liter, three-necked round-bottom flask, equipped with a reflux condenser, a dropping funnel, a mechanical stirrer, and a wet test meter was placed 228 grams (1.86 moles) of decaborane (Technical Grade) dissolved in 2 liters of acetonitrile (distilled over $P_2O_5$). The solution was brought to reflux with stirring, and 205 grams (2.1 moles) of propargyl acetate was added dropwise over a one and one-half hour period. The solution was refluxed for an additional three hours at the end of which time gas evolution was very slight. The clear orange solution was cooled and the majority of the acetonitrile distilled off under reduced pressure. To the resulting viscous liquid was slowly added approximately 400 ml. of 10% KOH. This mixture was extracted three times with 500 cc. portions of pentane. The combined extracts were then washed with 300 ml. of 10% NaOH, separated, and dried over anhydrous magnesium sulfate. After filtration and removal of the pentane solvent under reduced pressure, there were obtained approximately 245 grams of dekenylmethyl acrylate which was a low-melting, slightly yellow solid. This represents a 60% yield, based on decaborane. Recrystallization was effected from pentane giving a white crystalline solid of m.p. 47° to 48° C.

Analysis Calculated for $C_5H_{18}B_{10}O_2$: C, 27.50; H, 8.31; B, 49.54; Found: C, 28.04; H, 7.71; B, 49.45.

Preparation of Dekenylmethanol

Into a 2 liter, three-necked flask equipped with a condenser, a mechanical stirrer, a dropping funnel, and a nitrogen inlet bubbler was placed 15.0 grams of $LiAlH_4$ and 600–700 ml. of anhydrous ether. The solution was then refluxed under dry nitrogen for approximately one-half hour to dissolve the $LiAlH_4$. To this was added a solution of 93 grams (0.43 mole) of dekenylmethylacetate in 300 ml. of anhydrous ether at a rate which allowed the maintenance of a moderate reflux. After addition was complete, the mixture was stirred for an additional one-half hour. Methanol was then added slowly to the reaction mixture until reaction ceased. The resulting solution was poured into water and concentrated HCl was added until the solid was completely dissolved. The ether layer was separated and the aqueous layer extracted with ether. The combined ether extracts were then dried over anhydrous magnesium sulfate, filtered, and the ether removed under reduced pressure. The dekenylmethanol which was obtained weighed 70.0 grams, representing approximately a 93% yield. A sample of this material was twice recrystallized from pentane giving waxy plates having a m.p. of 221° to 223° C.

Analysis Calculated for $C_3H_{16}B_{10}O$: C, 20,43; H, 9.15; B, 61.35; Found: C, 21.46; H, 8.60; B, 60.02.

Diethinyl Carbinyl Acetate

To a 200 ml. three-necked flask fitted with mechanical stirrer, reflux condenser with protective Drierite drying tube and dropping funnel was introduced 15.0 grams (0.1875 mole) diethinyl carbinol, 17.0 grams (0.215 mole) pyridine and 100 ml. dry ether. The reaction mixture was cooled to 0° to 5° C. using an ice-water bath. To the mixture was added 16.0 grams (0.204 mole) acetyl chloride at such a rate that the temperature was maintained below 10° C. The reaction was then completed by allowing it to stand for a period of 3 hours at room temperature. The reaction mixture was washed with water and extracted with ether. The ether extracts were combined and dried over anhydrous magnesium sulfate. After removal of the ether, the liquid residue was vacuum-distilled. The product, diethinyl carbinyl acetate, b.p. 39° to 40° C. (2–3 mm.), $n^{20}$ 1.4426 was collected. Its infrared spectrum and elemental analysis were consistent for the desired product, diethinyl carbinyl acetate. The yield was 16.4 grams (71.5%).

Analysis Calculated for $C_7H_6O_2$: C, 68.75; H, 4.92; Found: C, 68.88; H, 5.33.

Didekenyl Carbinyl Acetate

A solution of 6.0 grams (0.0491 mole) decaborane in 60 ml. of dry acetonitrile was introduced into a 100 ml. flask fitted with magnetic stirrer, reflux condenser with protective Drierite drying tube, dropping funnel and gas-inlet tube. The reaction flask was flushed thoroughly with nitrogen and the nitrogen flow continued during the entire reaction. The reaction temperature was then increased to reflux and immediately an acetonitrile diethinyl carbinyl acetate solution (25 ml. — 3.0 grams) (0.245 mole) added over the course of fifteen minutes. The reaction was maintained at reflux for a period of 5 ½ hours. On cooling, the acetonitrile was removed and the residue neutralized slowly by the addition of excess of cold 10% sodium hydroxide with external cooling in an ice-water bath. The aqueous solution was then placed in a liquid-liquid extractor with pentane and the extraction continued for 72 hours. The pentane extracts were dried over magnesium sulfate after which the pentane was evaporated leaving a liquid residue of 5.73 grams (65.5% yield of didekenyl carbinyl acetate).

Didekenyl Carbinol

To a 200 ml. three-necked flask equipped with magnetic stirrer, reflux condenser with protective Drierite drying tube and dropping funnel was introduced 100 ml. anhydrous ether and 3.8 grams (0.1 mole) lithium aluminum hydride. The ether was brought to reflux for a period of one hour after which a solution of 14.38 grams (0.0394 mole) didekenyl carbinyl acetate in 25 ml. anhydrous ether was added dropwise to the reaction flask. The reaction was continued for 2 hours after the addition was completed. Methanol was then added to remove the excess lithium aluminum hydride. The reaction mixture was then added slowly to cold dilute hydrochloric acid and extracted with ether. The ether extracts were dried over magnesium sulfate, then the ether was removed to yield 16.2 grams of oily residue. The infrared spectrum of the residue showed that the desired product, didekenyl carbinol, had been obtained. The product was recrystallized from pentane, m.p. 185° to 187° C.

Analysis Calculated for $C_5H_{28}B_{20}O$: C, 18.75; H, 8.75; B, 67.5; Found: C, 19.61; H, 7.47; B, 66.7.

The following examples set forth certain well-defined embodiments of the application of this invention. They are not, however, to be considered as limitations thereof, since many modifications may be made without departing from the spirit and scope of this invention.

Unless otherwise specified, all parts are parts by weight. Unless otherwise noted, all temperatures are centigrade.

EXAMPLE I

Didekenyl Carbinyl Acrylate

To a 200 ml. three-necked flask equipped with magnetic stirrer, reflux condenser with protective Drierite drying tube and dropping funnel was added 3.20 grams (0.01 mole) dekenyl carbinol, 100 ml. anhydrous ether and 0.84 gram (0.01 mole) phenyl lithium. After standing for thirty minutes with stirring, 0.91 gram (0.01 mole) of acryloyl chloride was added dropwise with external cooling of the reaction mixture in an ice-water bath. The reaction was completed on standing for 2 hours. The mixture was washed with water, then the ether layer dried over magnesium sulfate followed by removal of the ether to give a oily residue whose infrared spectrum was consistent with that expected of didekenyl carbinyl acrylate. Crude yield was 3.68 grams. The oily residue crystallized in part on standing overnight and was almost completely crystalline on standing for 72 hours. Several attempts to recrystallize were unsuccessful. The residue was then permitted to stand until partly crystallized. The crystalline material was washed several times with cold pentane and collected by filtration, m.p. 114° to 116° C.

Analysis Calculated for $C_8H_{30}B_{20}O_3$: C, 25.62; H, 8.01; B, 57.70; Found: C, 26.52; H, 7.58; B, 55.00.

EXAMPLE II

Preparation of Dekenylmethyl Acrylate

A solution consisting of 68 grams (0.39 mole) of dekenylmethanol, 45.0 grams (0.44 mole) of triethylamine, a small amount of inhibitor and 250 ml. of acetonitrile (distilled over $P_2O_5$) was placed in a 1 liter, three-necked, round-bottom flask equipped with a condenser, a mechanical stirrer, and a dropping funnel. To this solution was slowly added with stirring and under dry nitrogen a solution of 45.0 grams (0.56 mole) of acryloyl chloride in 100 cc. of acetonitrile (distilled over $P_2O_5$) at such a rate that moderate reflux was maintained. After the addition was complete, stirring was continued for 1 hour during which time the reaction cooled to room temperature. The reaction mixture was poured into an ice water-ether mixture and concentrated HCl was added until the solution was acid to litmus. The resulting ether layer was separated and the aqueous layer extracted once with additional ether. The combined ether extracts were then washed with water, separated and dried over anhydrous magnesium sulfate followed by removal of the ether under reduced pressure. The oil which resulted weighed 82.0 grams representing a 91% yield based on decaborane. This oil was stirred with water at room temperature for approximately 2 hours after which ether was added and the aqueous layer separated. The ethereal solution was washed with sodium carbonate solution, separated, and dried followed by removal of the ether. The resulting oil to which a small amount of inhibitor was added was distilled in a "short path" vacuum distillation apparatus. Approximately 75 cc. of dekenyl methyl acrylate distilled over at 85° to 90° C. at $10^{-4}$ to $10^{-5}$ mm. Hg. using a pot temperature of approximately 125° C. This liquid crystallized to a solid which had a m.p. of 17° to 18° C.

EXAMPLE III

The Preparation of Didekenylmethyl Carbinyl Acrylate

Into a three-necked flask equipped with a reflux condenser, dropping funnel and magnetic stirrer was placed 34.8 grams of didekenylmethyl carbinol and 200 ml. of dry ether. The system was flushed with dry nitrogen and 90 ml. of 1.11 molar phenyl lithium solution was added dropwise. After the addition, the reaction mixture was stirred for 30 minutes and 12.0 grams of acryloyl chloride and 50 ml. of ether was added slowly. The reaction mixture was stirred overnight. It was then poured into water, the ether solution was washed with water, dried over magnesium sulfate, and the solvent removed. Pentane was added to the residue and the solid filtered off, washed with pentane and dried. The weight of the didekenylmethyl carbinyl acrylate obtained was 15.5 grams. A sample was recrystallized from ethanol three times, m.p. 148° to 150° C.

Analysis Calculated for $C_{10}H_{34}B_{20}O_2$: C, 29.82; H, 8.51; B, 53.73; Found: C, 30.40; H, 7.73; B, 54.12.

EXAMPLE IV

An equimolar quantity of methacryloyl bromide was substituted for the acryloyl chloride of Example III. Didekenylmethyl carbinyl methacrylate was obtained in good yield.

Molar equivalents of butyllithium, fluorenyllithium, trityllithium and naphthalenelithium were substituted for the phenyllithium of this example with equally satisfactory results.

EXAMPLE V

An equimolar quantity of methacryloyl chloride was substituted for the acryloyl chloride of Example II. Dekenylmethyl methacrylate was isolated from the reaction mixture in good yield using the technique set forth in Example II.

EXAMPLE VI

Dekenylmethyl acrylate (76 parts by weight) was mixed with 20 parts by weight of triethylene glycol dinitrate, 3 parts by weight of a polyester which was a 50% solution of a maleic acid-propylene glycol condensate in diallyl phthalate, and one part by weight of benzoyl peroxide and cured at 60° C. for 48 hours. A tough, rubbery polymer was obtained.

EXAMPLE VII

Dekenylmethyl acrylate (69 parts by weight) was mixed with 20 parts by weight of triethylene glycol dinitrate, 6 parts by weight of 2-ethylhexyl acrylate, 4 parts by weight of a polyester which was a 50% solution of a maleic acid-propylene glycol condensate in diallyl phthalate, and 1 part by weight of benzoyl peroxide and cured at 60° C. for 48 hours. While a tough elastic polymer was obtained, it was not as tough as the polymer of Example VI due to the plasticizing action of the 2-ethylhexyl acrylate component.

EXAMPLE VIII

Didekenylmethyl carbinyl acrylate (69 parts by weight) was mixed with 18 parts by weight of dekenylmethyl nitrate, 6 parts by weight of ethylene glycol dimethacrylate, 6 parts by weight of ethyl acrylate and 1 part by weight of benzoyl peroxide and cured at 65° C. for 45 hours. Although this polymer was softer than the polymers of Examples VI and VII, it was less thermoplastic because of the crosslinking effect of the ethylene glycol dimethacrylate.

I claim:

1. A process for the preparation of a compound selected from the group consisting of dekenyl acrylates and methacrylates which comprises reacting hydroxy dekenyl compounds with acyl halides of an acid selected from the group consisting of acrylic and methacrylic acids, the halogen of said acyl halide having an atomic weight of 35 to 80.

2. A process as set forth in claim 1 in which the reaction is conducted in the presence of a trialkylamine.

3. An ester of the formula

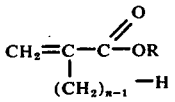

in which $n$ is 1 to 2 and R is a radical selected from the group consisting of $(H\not{o}CH_2)_2CH-$, $(H\not{o})_2CH-$, $H\not{o}CH_2-$, $H\not{o}(CH_2)_2-$, $H\not{o}(CH_2)_3-$, $H\not{o}(CH_2)_4-$, $H\not{o}(CH_2)_5-$, and $(CH_3\not{o})_2CH-$ in which formula $-\not{o}-$ represents $-C_2B_{10}H_{10}-$.

4.

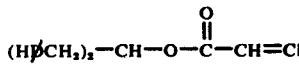

in which formula $-\not{o}-$ represents $-C_2B_{10}H_{10}-$.

5.

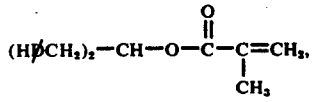

in which formula $-\not{o}-$ represents $-C_2B_{10}H_{10}-$.

6.

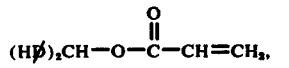

in which formula $-\not{o}-$ represents $-C_2B_{10}H_{10}-$.

7.

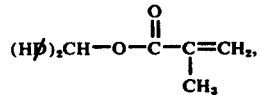

in which formula $-\not{o}-$ represents $-C_2B_{10}H_{10}-$.

8.

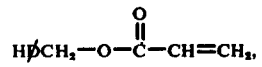

in which formula $-\not{o}-$ represents $-C_2B_{10}H_{10}-$.

9.

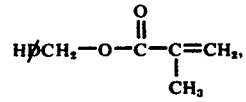

in which formula $-\not{o}-$ represents $-C_2B_{10}H_{10}-$.

10.

$$(CH_3\not{D})_2CH-O-\overset{O}{\overset{\|}{C}}-CH=CH_2,$$

in which formula —$\not{D}$— represents —$C_2B_{10}H_{10}$—.

11.

$$(CH_3\not{D})_2CH-O-\overset{O}{\overset{\|}{C}}-\underset{CH_3}{\underset{|}{C}}=CH_2,$$

in which formula —$\not{D}$— represents —$C_2B_{10}H_{10}$—.

12. Polymers of the formula $$\left[ -CH_2-\underset{\underset{C=O}{|}}{\underset{(CH_2)_{n-1}-H}{\underset{|}{C}}}- \quad \begin{matrix} \diagdown \\ OR \end{matrix} \right]_X$$

in which $n$ is 1 to 2, R is a radical selected from the group consisting of $(H\not{D}CH_2)_2CH$—, $(H\not{D})_2CH$—, $H\not{D}CH_2$—, $H\not{D}(CH_2)_2$—, $H\not{D}(CH_2)_3$—, $H\not{D}(CH_2)_4$—, $H\not{D}(CH_2)_5$—, and $(CH_3\not{D})_2CH$—, X is about 5 to 3000, and —D— represents —$C_2B_{10}H_{10}$—.

13. Copolymers of the monomers of claim 3 and an alkyl acrylate.

14. Copolymers of the monomers of claim 3 and an alkyl methacrylate.

15. Polymers of claim 12 containing from 5 to 30% on the weight of the polymer of a nitrato ester of an alcohol containing 1 to 10 carbon atoms and having 1 to 3 hydroxyl groups.

16. Copolymers of claim 13 containing from 5 to 30% on the weight of the polymer of a nitrato ester of an alcohol containing 1 to 10 carbon atoms and having 1 to 3 hydroxyl groups.

17. Copolymers of claim 14 containing from 5 to 30% on the weight of the polymer of a nitrato ester of an alcohol containing 1 to 10 carbon atoms and having 1 to 3 hydroxyl groups.

18. Copolymers of the monomers of claim 3 with a polymerizable polyethylenically unsaturated compound.

* * * * *